US007401453B2

(12) United States Patent
Ford

(10) Patent No.: US 7,401,453 B2
(45) Date of Patent: Jul. 22, 2008

(54) PACKAGING SYSTEM HAVING LOADING CAROUSEL

(75) Inventor: Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/437,394

(22) Filed: May 19, 2006

(65) Prior Publication Data

US 2006/0207220 A1 Sep. 21, 2006

(51) Int. Cl.
*B65B 5/06* (2006.01)
*B65B 21/06* (2006.01)
*B65B 21/14* (2006.01)

(52) U.S. Cl. ..... 53/543; 53/564; 53/251

(58) Field of Classification Search ..... 53/543, 53/48.8, 564, 381.1, 534, 539, 244, 246–248, 53/250, 251, 253
See application file for complete search history.

(56) References Cited

U.S. PATENT DOCUMENTS

| | | | | | |
|---|---|---|---|---|---|
| 2,757,498 | A | | 8/1956 | Gunther et al. | |
| 2,921,425 | A | * | 1/1960 | Seval | 53/247 |
| 3,041,805 | A | * | 7/1962 | Fulco | 53/247 |
| 3,091,903 | A | * | 6/1963 | Kammerer | 53/253 |
| 3,283,471 | A | | 11/1966 | Thurston et al. | |
| 3,368,766 | A | | 2/1968 | Livingston | |
| 3,481,108 | A | * | 12/1969 | Justis et al. | 53/534 |
| 3,491,506 | A | | 1/1970 | Kund et al. | |
| 3,521,427 | A | * | 7/1970 | Masch | 53/564 |
| 3,592,003 | A | | 7/1971 | Stichhan | |
| 3,848,519 | A | * | 11/1974 | Ganz | 53/564 |
| 3,940,907 | A | * | 3/1976 | Ganz | 53/564 |
| 4,100,715 | A | | 7/1978 | Ganz | |
| 4,332,123 | A | * | 6/1982 | Calvert | 53/564 |
| 4,389,832 | A | | 6/1983 | Calvert | |
| 4,391,078 | A | * | 7/1983 | Nigrelli | 53/251 |
| 4,481,752 | A | | 11/1984 | Sabel | |
| 4,570,413 | A | | 2/1986 | Raudat | |
| 4,802,324 | A | | 2/1989 | Everson | |
| 4,878,337 | A | * | 11/1989 | Raudat et al. | 53/534 |
| 4,947,617 | A | | 8/1990 | Focke et al. | |
| 4,949,531 | A | * | 8/1990 | Langenbeck et al. | 53/534 |
| 4,982,556 | A | | 1/1991 | Tisma | |
| 5,212,930 | A | | 5/1993 | Raudat | |

(Continued)

FOREIGN PATENT DOCUMENTS

DE 3529657 2/1987

(Continued)

OTHER PUBLICATIONS

Machine translation of DE 4216671 from the EPO website.

(Continued)

*Primary Examiner*—Stephen F Gerrity
(74) *Attorney, Agent, or Firm*—Womble Carlyle Sandridge & Rice, PLLC

(57) ABSTRACT

A packaging system utilizes two sides of a loading carousel, which reduces both the height and footprint of the packaging system. Mass and inertia are also reduced, allowing higher operational speeds. The loading carousel receives opened cartons on a first side and lowers them over product groups on a second side.

6 Claims, 12 Drawing Sheets

U.S. PATENT DOCUMENTS

| | | | |
|---|---|---|---|
| 5,237,801 | A | 8/1993 | Hillam et al. |
| 5,241,805 | A | 9/1993 | Johnson |
| 5,381,639 | A | 1/1995 | Calvert et al. |
| 5,454,211 | A | 10/1995 | Ziegler |
| 5,558,489 | A | 9/1996 | Moncrief et al. |
| 5,626,002 | A | 5/1997 | Ford et al. |
| 5,630,311 | A | 5/1997 | Flix |
| 5,671,587 | A | 9/1997 | Robinson |
| 5,784,857 | A | 7/1998 | Ford et al. |
| 5,826,408 | A | 10/1998 | Ford |
| 5,979,147 | A | 11/1999 | Reuteler |
| 6,050,063 | A | 4/2000 | Ford et al. |
| 6,240,707 | B1 | 6/2001 | Ford et al. |
| 6,499,280 | B1 | 12/2002 | Tsutsui |
| 6,550,608 | B1 | 4/2003 | Brown et al. |
| 6,571,532 | B1 | 6/2003 | Wiernicki et al. |
| 6,695,570 | B2 | 2/2004 | Ford et al. |
| 6,907,979 | B2 | 6/2005 | Ford et al. |
| 6,993,889 | B2 | 2/2006 | Ford |
| 7,104,027 | B2 | 9/2006 | Ford et al. |
| 2006/0042188 | A1 | 3/2006 | Ford |

FOREIGN PATENT DOCUMENTS

| | | | |
|---|---|---|---|
| DE | 4216671 | A1 | 9/1993 |
| DE | 102 03 459 | | 7/2003 |
| EP | 0 388 606 | A2 | 9/1990 |
| WO | WO 99/14122 | | 3/1999 |
| WO | PCT/US2007/010371 | | 4/2007 |

OTHER PUBLICATIONS

Machine translation of DE 3529657 from the EPO website.
Machine translation of WO 03064270 (corresponds to DE 10203459) from the EPO website.

* cited by examiner

PACKAGING SYSTEM HAVING LOADING CAROUSEL

TECHNICAL FIELD

The present invention relates generally to a high speed packaging machine having a loading carousel.

BACKGROUND

The packaging of articles such as bottles, cans, and other similar articles in cartons or other containers is a highly automated process, with conventional automated packaging equipment generally being run at high packaging speeds in order to maximize output. In a typical packaging machine for packaging articles such as bottles, cans and the like, articles to be packaged are fed into the packaging machine in a line or series of lines along an infeed conveyor, after which the articles are grouped together in various standard configurations or groupings, such as four, six, eight, twelve, or twenty-four pack configurations. The groups of articles are then packaged into a box, a carton, or other type of container. The placement of the articles within a container can be done in a variety of ways, depending upon the type of package in which the articles are to be placed. For example, the bottoms of cartons can be opened and the cartons then placed over selected groups of articles as the articles are moved along a transport path.

A conventional packaging machine is shown in FIG. 1. The machine functions generally are performed in a line extending through the machine. As shown in FIG. 1, product metering is operated by star wheels at Station 1. At Station 2, product selection blocks separate the product into groups to be loaded into individual cartons. At Station 3, a carousel pick-up selects individual cartons for loading. At Station 4, a carton transport controls the carton through plows and an opening assembly. At Station 5, the carton opener opens the cartons between pairs of vacuum manifold assemblies. At Station 6, the carousel vertically lowers the opened cartons over and onto the product groups. At Station 7, a closing section closes the carton base about the bottle group contained therein and compression is applied on the underside of the discharge belt to secure the carton in a closed position.

Given the high speeds at which the packaging machine is operated, the linear footprint of the machine must be large in order to ensure that the path of travel of the cartons is sufficient to ensure that the cartons are fully opened before being placed over a group of articles. However, plant space often is at a premium and it is not always possible to extend machinery to an optimal size. To prevent jams or misfeeds, the speed at which the articles are packaged must then typically be reduced in order to ensure that the cartons are fully opened prior to packaging the articles therein. Output is accordingly reduced.

Even in cases where the linear extent of the packaging machine is not limited, a large loading carousel necessarily has a large mass of moving parts, which entails a correspondingly large inertia during operation. Drive mechanisms must therefore be larger, and high speed operation of the larger machine may result in higher maintenance costs, higher rates of failure, and other manufacturing problems.

The conventional packaging machine also has a large vertical height. As shown in FIG. 1, cartons are picked up at Station 3 at a raised position and lowered onto the bottles at Station 6. Because the carton pickup and carton loading steps are performed along a line, the height of the carousel must be sufficient to accommodate the highest point of the stroke (i.e., before pickup), and the lowest point of the stroke (i.e., at loading).

SUMMARY OF THE INVENTION

Briefly described, the present invention generally is directed to a high speed packaging system for packaging various types of articles in a variety of different configurations of containers or cartons. The articles, such as bottles, cans, or the like, generally will be fed into and through the packaging system of the present invention along a path of travel on an infeed conveyor on an upstream side of the packaging system. The articles can be separated in one or more lanes of products, in side by side or in staggered configurations.

As the articles are fed into the upstream or receiving end of the packaging system, the articles pass through a selector station for selecting and grouping the articles into groups. As the articles are separated into their packaging groups, the groups of articles are further transferred to a packaging line along which the groups of articles are placed into containers. The packaging line may generally extend along a path substantially parallel to the path of travel of the articles along the infeed conveyor, although other orientations are possible.

A carton loading carousel will be positioned adjacent to and extend parallel to the packaging line, and includes a series of carton carriers moving thereabout. In accordance with one aspect of the present invention, the carriers are moved about the carousel from a carton pickup point along a first side of the carousel, and subsequently moved into a loading position along a second side of the carousel. The carriers can be moved along a cam track that extends about the periphery of the carousel to raise and lower the cartons as the cartons are moved between pickup and loading positions. At this loading position, the cartons are engaged with a selected group of articles moving along the packaging line. In one embodiment, the cartons can be lowered as they approach their loading position, with the cartons being moved forwardly and downwardly over the selected group of articles to load the articles within the cartons. Alternatively, in another embodiment, the cartons can be moved from a lowered position passing below an article infeed line for the articles, to an elevated loading position. As the cartons are moved upwardly beneath a selected group of articles, the articles are loaded into one or more compartments of the cartons from above the cartons.

The cartons may be provided by a carton infeed system and opened in a carton opener. The opening and pickup of the cartons may be accomplished along an initial portion of a carton loading path that is substantially parallel to but extending opposite or spaced from the packaging line so that two sides of the loading carousel are utilized.

According to one aspect of the present invention, use of two sides of the loading carousel allows the packaging system to open and load cartons with groups of articles in a significantly reduced length, space, and/or footprint, without reducing packaging speed. Also, because the pickup stroke can occur on one side of the carousel, and the loading stroke can occur on the opposite side, the loading carousel can be significantly shorter in height than conventional carousels. In addition, the relatively small size of the loading carousel reduces the mass of moving parts in the carousel, meaning a smaller inertia during operation.

Various objects, features and advantages of the present invention will become apparent to those skilled in the art upon reading the following detailed description and taken in conjunction with the accompanying drawings.

DETAILED DESCRIPTION

FIGS. 2-7 illustrate a high speed packaging system 10 according to a first embodiment of the present invention. In this embodiment, the packaging system 10 generally is designed to provide a substantially continuous motion system for high speed packaging of various types of articles in a variety of configurations of containers, including, for example, six-pack, four-pack, or eight-pack cartons, as well as smaller or larger configurations. For the purposes of illustration and simplicity of description, the packaging system embodiment discussed in detail below is described as loading bottles B into cartons C to form packages P.

Figure 1:
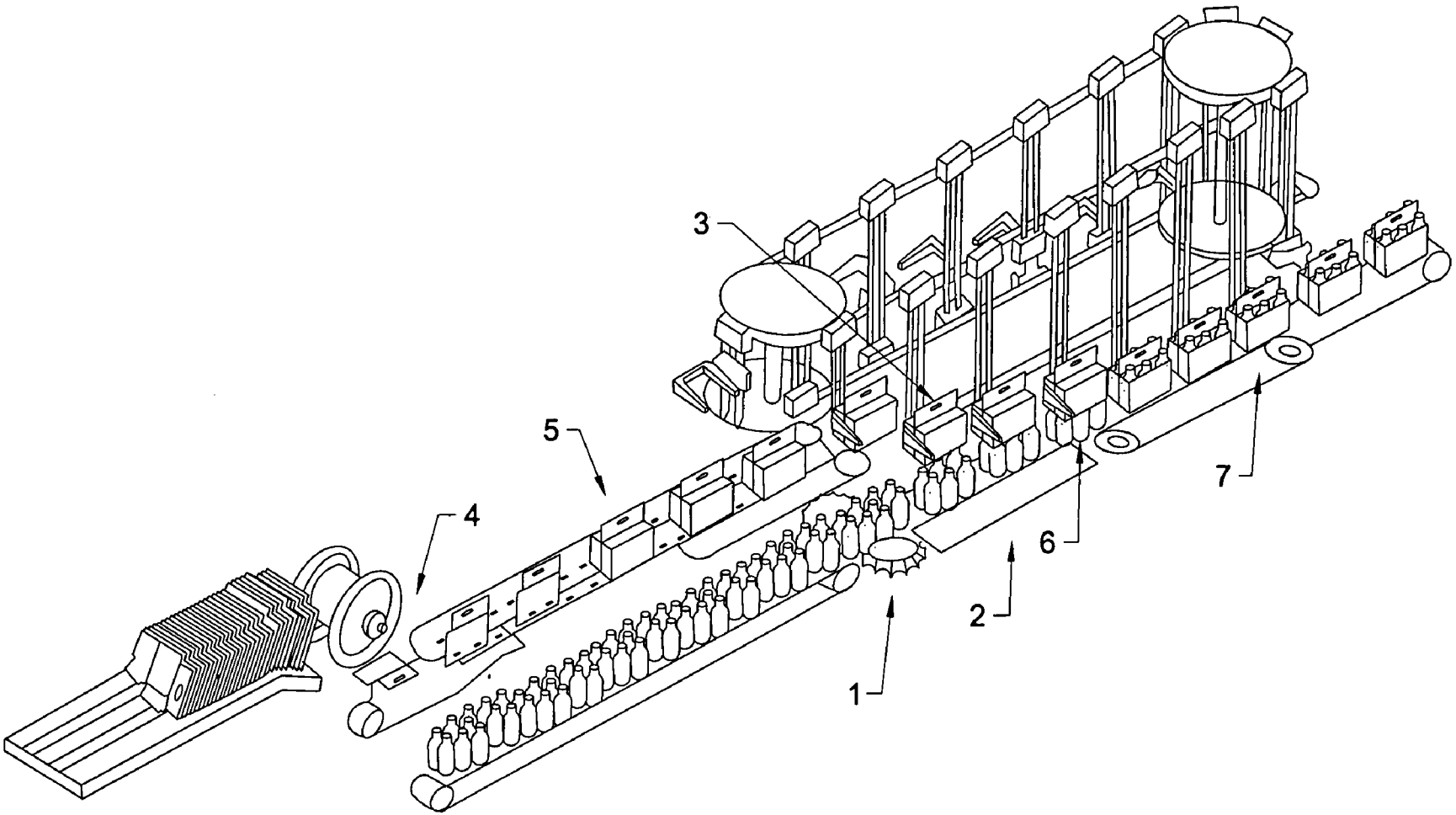
Fig. 1 (PRIOR ART)
FIG. 1 is a perspective view of a conventional prior art article packaging system.
Figure 2:
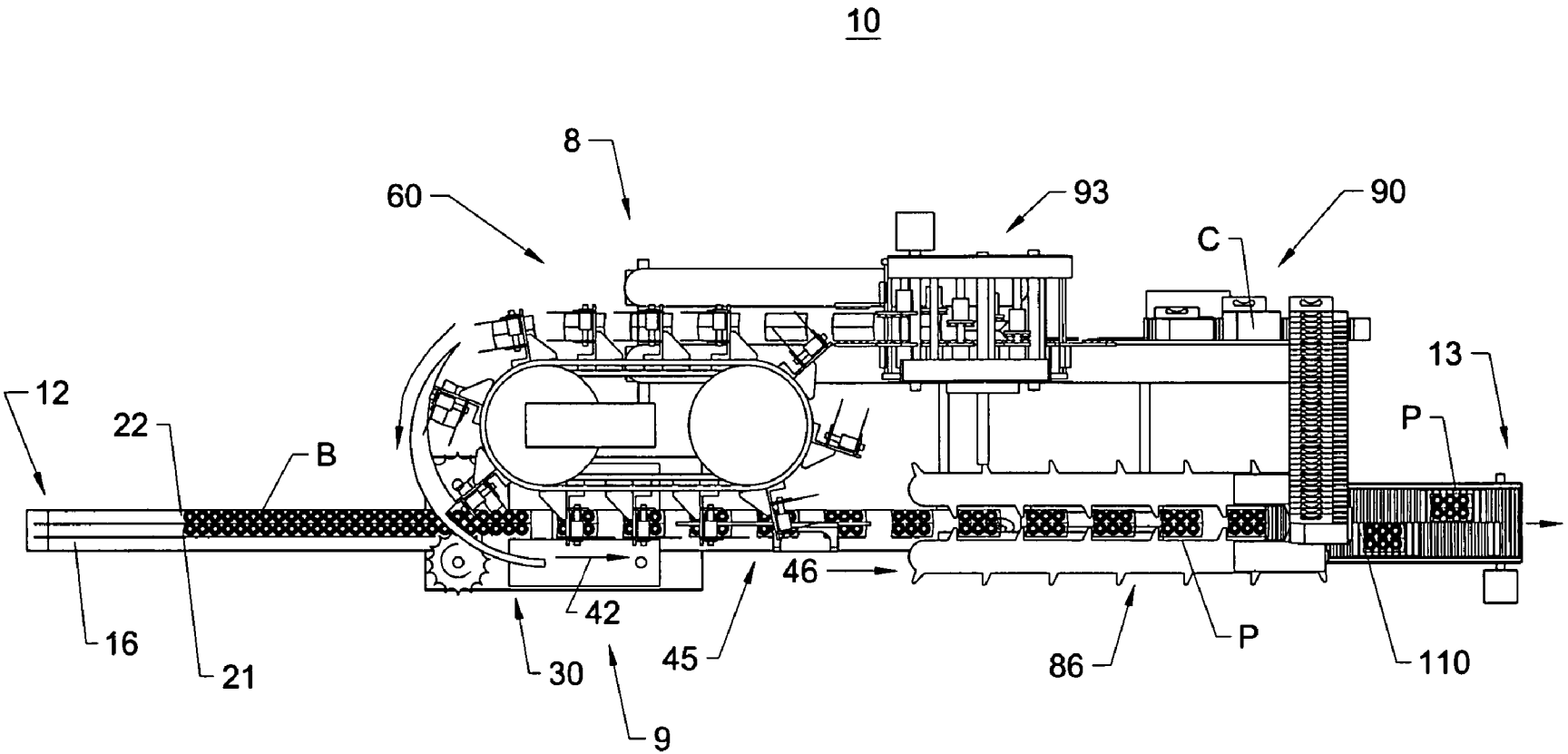
FIG. 2 is a top plan schematic view of a packaging system according to an embodiment of the present invention.

Referring to FIG. 2, the packaging system 10 has a first, upstream or inlet end 12 and a second, downstream or outlet end 13. The packaging system 10 comprises the following general components: a carton infeed system 90 having an opener 93 for providing opened cartons C in the system 10, a loading carousel 60 for loading bottles B in the cartons C, an article transport or infeed conveyor 16 for providing bottles B in the system 10, a selector station 30 for metering the flow of bottles B into the loading carousel 60, as indicated by arrow 42, a packaging line 45 for moving the cartons C and bottles B during loading, a closing mechanism 86 for engaging and closing the bottoms of the cartons C, and a outlet mechanism 110 for forwarding the packs P down the conveyor line for further handling and/or packaging. The packaging system 10 generally will also include a frame (not shown) or support housing. The frame can include, for example, one or more bays or doors to enable access to the packaging machine 10. The outlet mechanism 110 can be, for example, a two-way divider, as shown in FIG. 2.

As generally shown in FIG. 2, the loading carousel 60 has a first side 8 and a second side 9, both of which are used for opening and loading of cartons C. Using two sides 8, 9 of the carousel 60 for opening and loading has the effect of reducing both the required stroke and the number of flights or carriers required for opening and loading the cartons C. The required stroke and number of flights can be reduced, for example, by about half, when compared to conventional packaging machines having similar output capabilities. The reduction of the number of flights or carriers required accordingly reduces the plan area or footprint of the packaging system 10. This significant reduction in footprint in turn conserves valuable shop space. The reduction in stroke reduces the vertical height of the packaging system 10, in particular the height of the loading carousel 60.

As shown in FIG. 2, the carton infeed system 90 having the opener 93 is located on the first side 8 of the loading carousel 60. The article transport conveyor 16, the selector station 30, and the packaging line 45 are located on the second side 9 of the loading carousel 60. The structure and operation of the packaging system 10 are discussed in detail below with reference to FIGS. 2-7.

Figure 3:
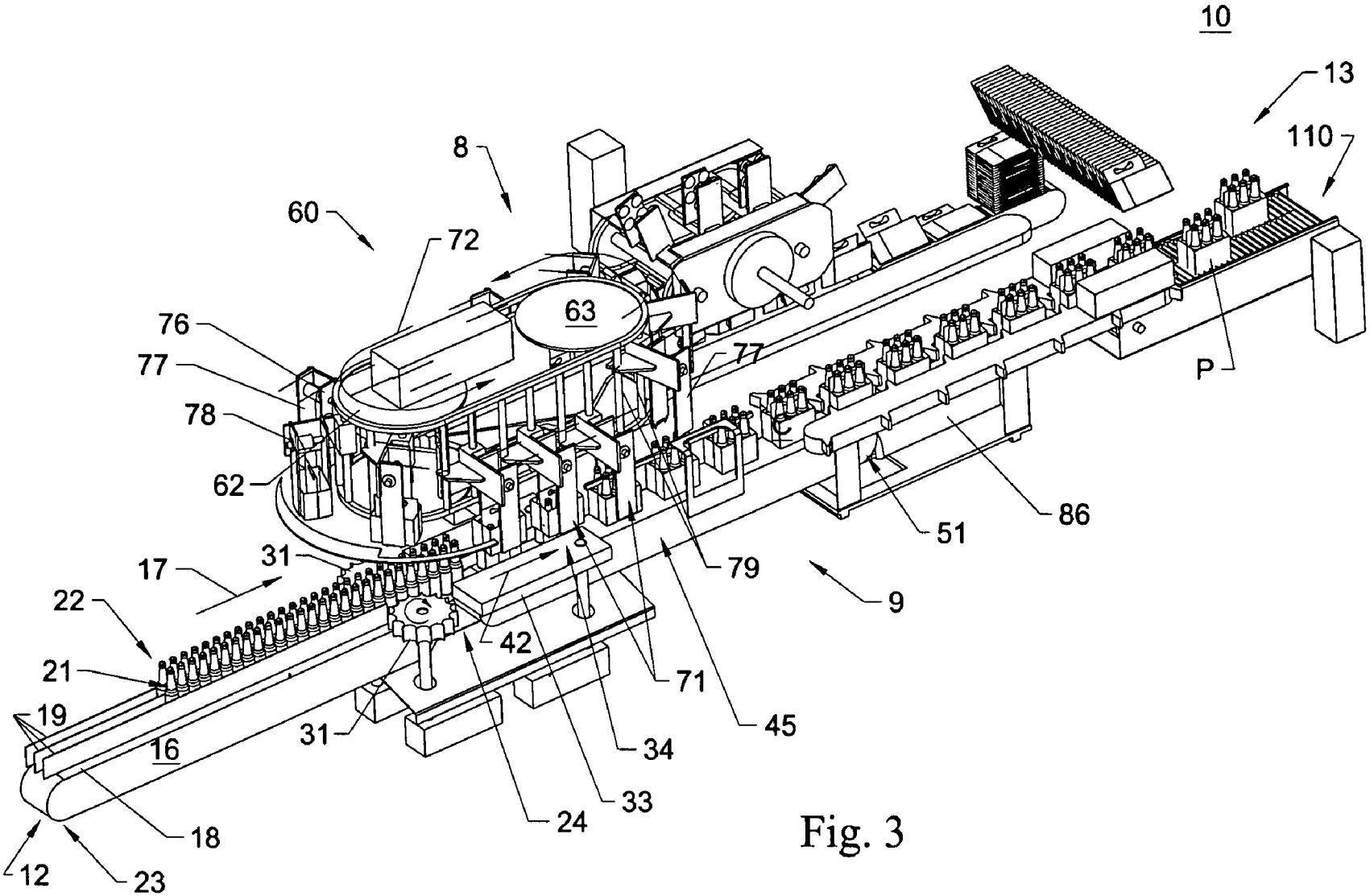
FIG. 3 is a perspective partial schematic view of the packaging system.
Figure 4A:
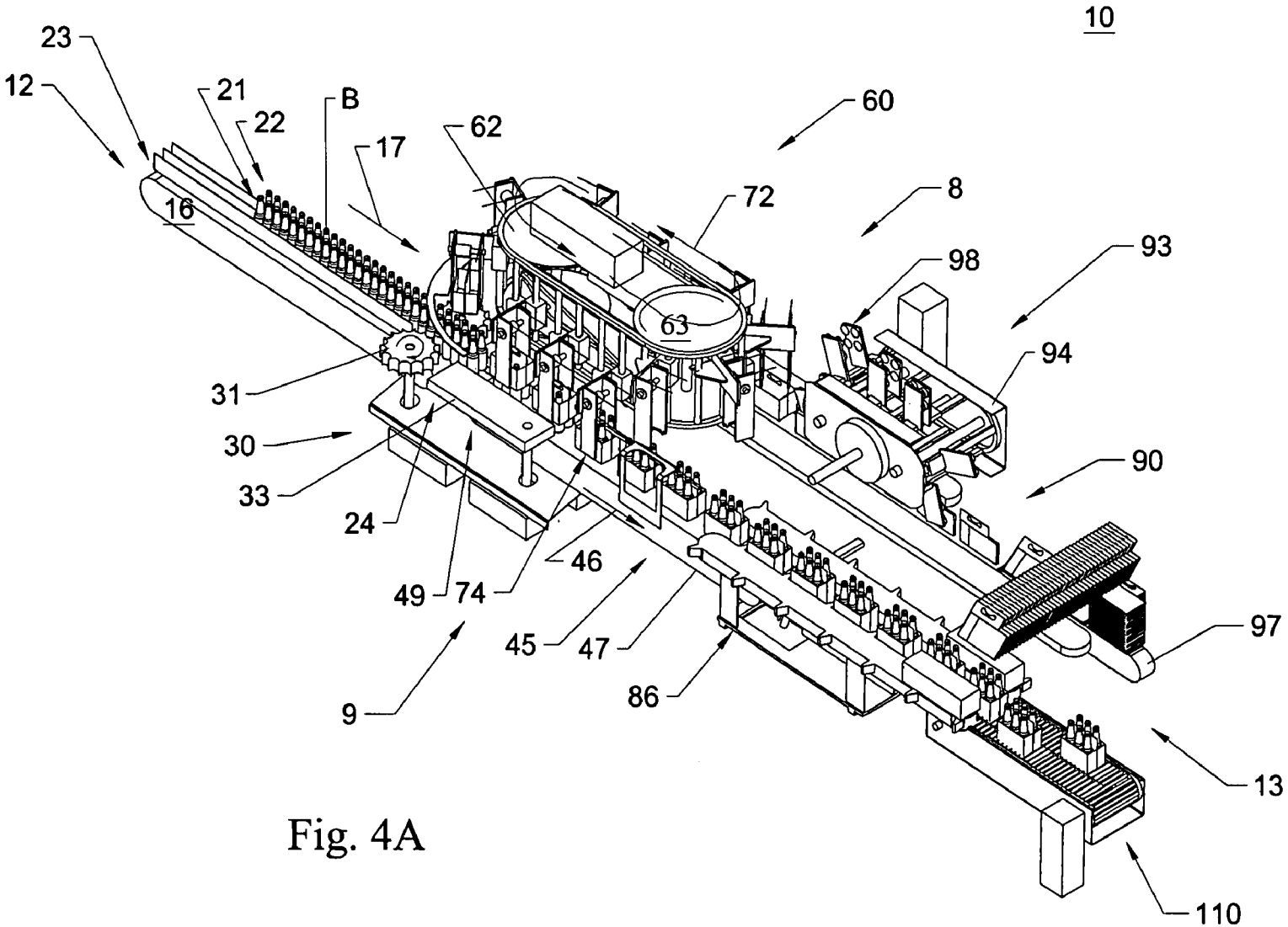
FIG. 4A is a perspective partial schematic view of the packaging system.
Figure 4B:
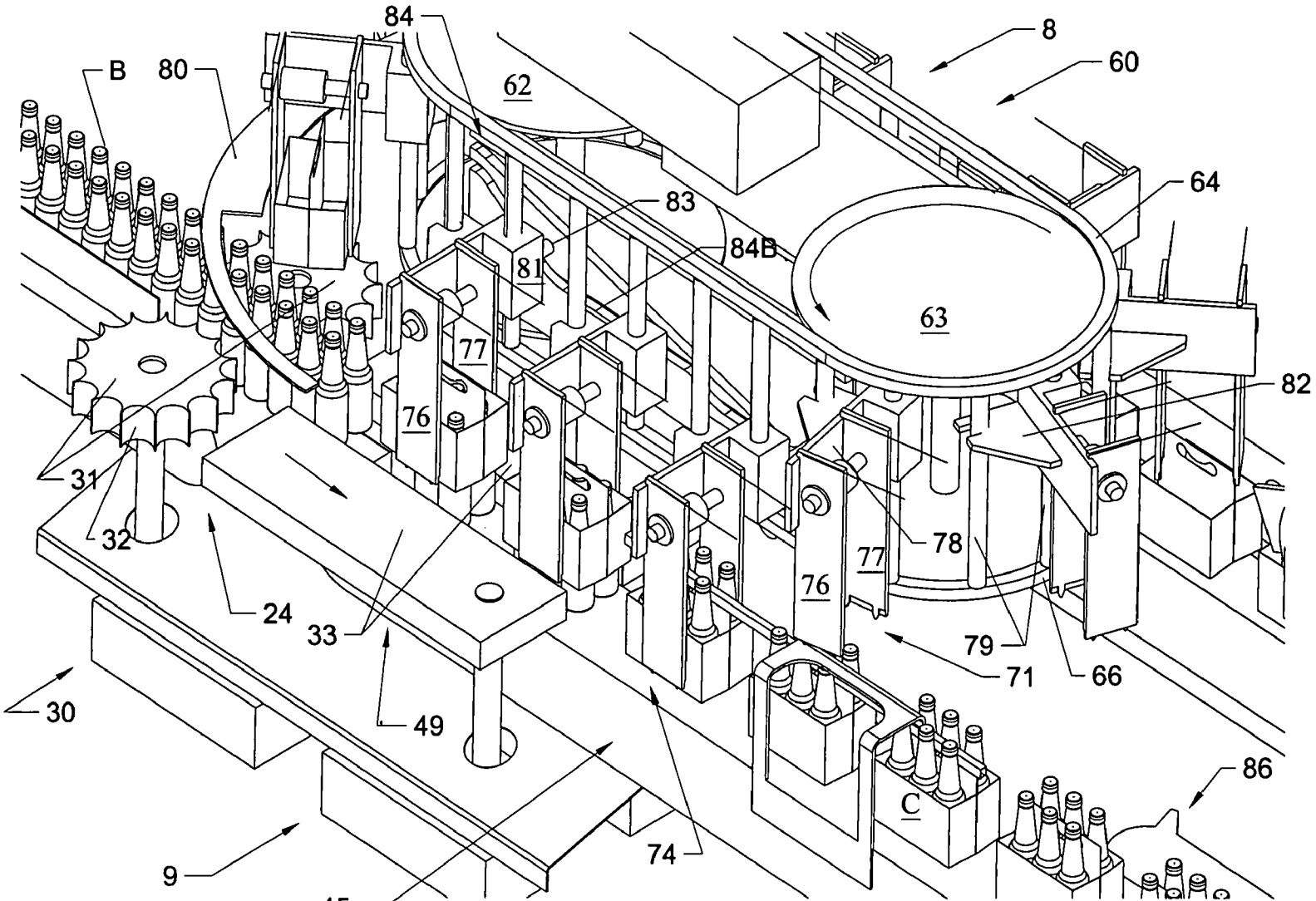
FIG. 4B is a partial perspective view showing the operation of a loading carousel according to an embodiment of the present invention.

Referring to FIGS. 3, 4A and 4B, the article transport conveyor 16 provides a supply of bottles B to the loading carousel 60. The article transport conveyor 16 generally is positioned at the upstream end 12 of the packaging system 10 for receiving the bottles B and moving them along an infeed path of travel indicated by arrow 17. The article transport conveyor 16 generally may be a belt, chain or other conventional type of conveyor having an upper surface 18 along which the bottles B are moved. The article transport conveyor 16 can include, for example, dividers 19 for separating the bottles B into one or more lanes 21, 22. The article transport conveyor 16 further includes a first or proximal end 23 where the bottles B are received from an upstream production line (not shown), and a second or distal end 24 where the bottles B are engaged and transferred from the article transport conveyor 16 by the selector station 30.

Referring to FIGS. 4A and 4B, the selector station 30 meters the flow of bottles B into the loading carousel 60 by ordering the bottles B into groups that are conveyed along the packaging line 45. The selector station 30 generally may include a series of metering or star wheels 31 having product receiving recesses 32 formed thereabout. The star wheels 31 engage and meter the flow of bottles B moving along the article transport conveyor 16, and redirect the lanes 21, 22 of bottles B toward a pair of selectors 33.

The selectors 33 may be conventional and are schematically illustrated in FIGS. 3, 4A and 4B. The selectors 33 may generally include upper and lower support plates and a series of pairs or sets of selector arms mounted therebetween. Each selector arm may include an article engaging or separating plate mounted at a front or proximal end thereof, with each separating plate having a series of teeth defining a series of recesses therebetween. The selector arms can be moveable radially from a retracted, initial position for engaging and moving a series of bottles B, e.g., 2, 3, 4, etc., depending upon how many bottles B are metered to carousel 60, as the selector arms are rotated with the rotation of the selectors 33. The selectors 33 can be configured to place bottles B into any desired configuration group, and typically will move at a different rate as they engage their respective groups of bottles B so as to create a separation or stagger between the groups of bottles to form a desired package grouping configuration. In the illustrated embodiment, the bottle groups have a 2×3 configuration.

Figure 5:
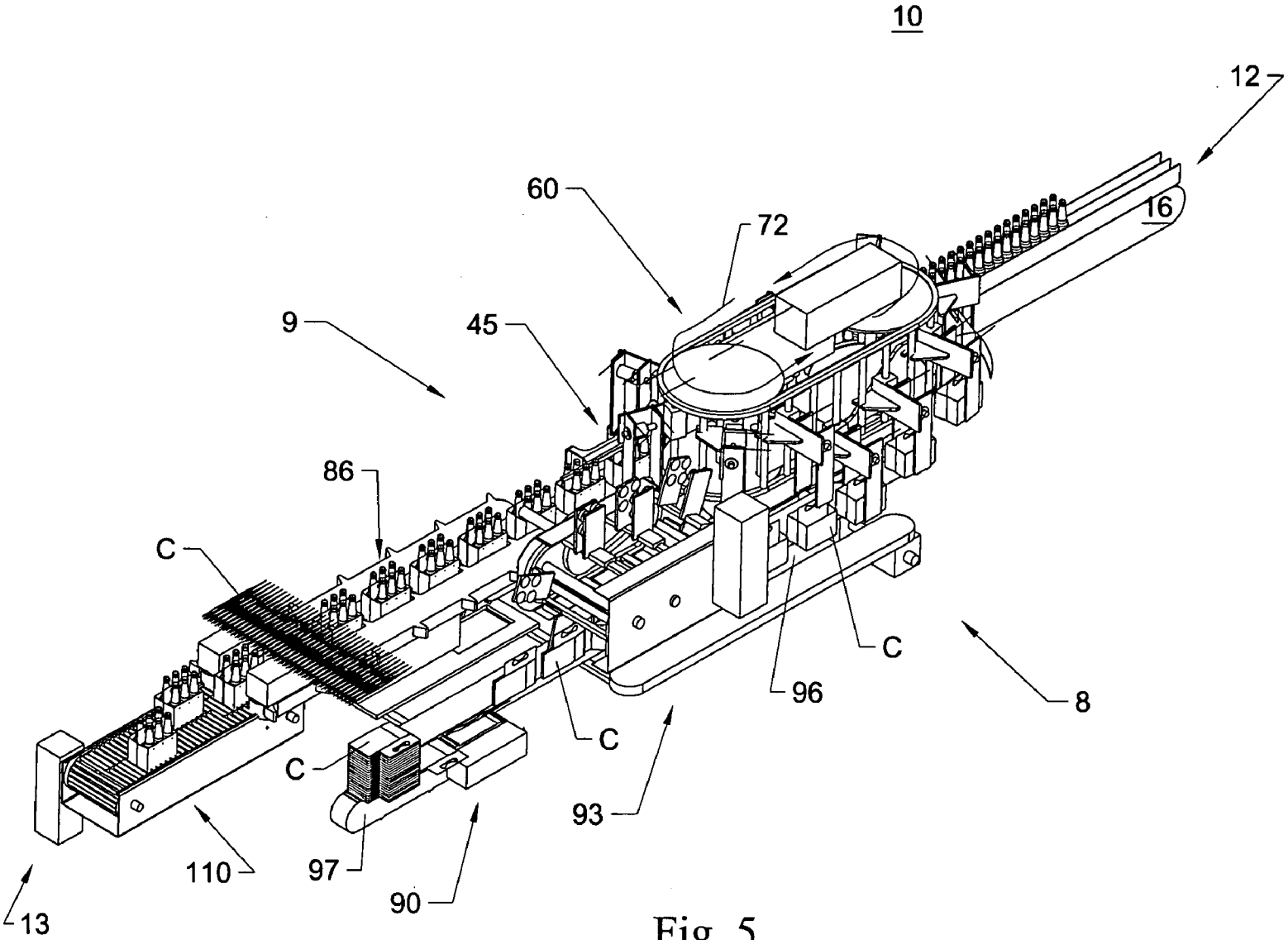
FIG. 5 is a perspective partial schematic view of the packaging system illustrating a carton infeed system.
Figure 6:
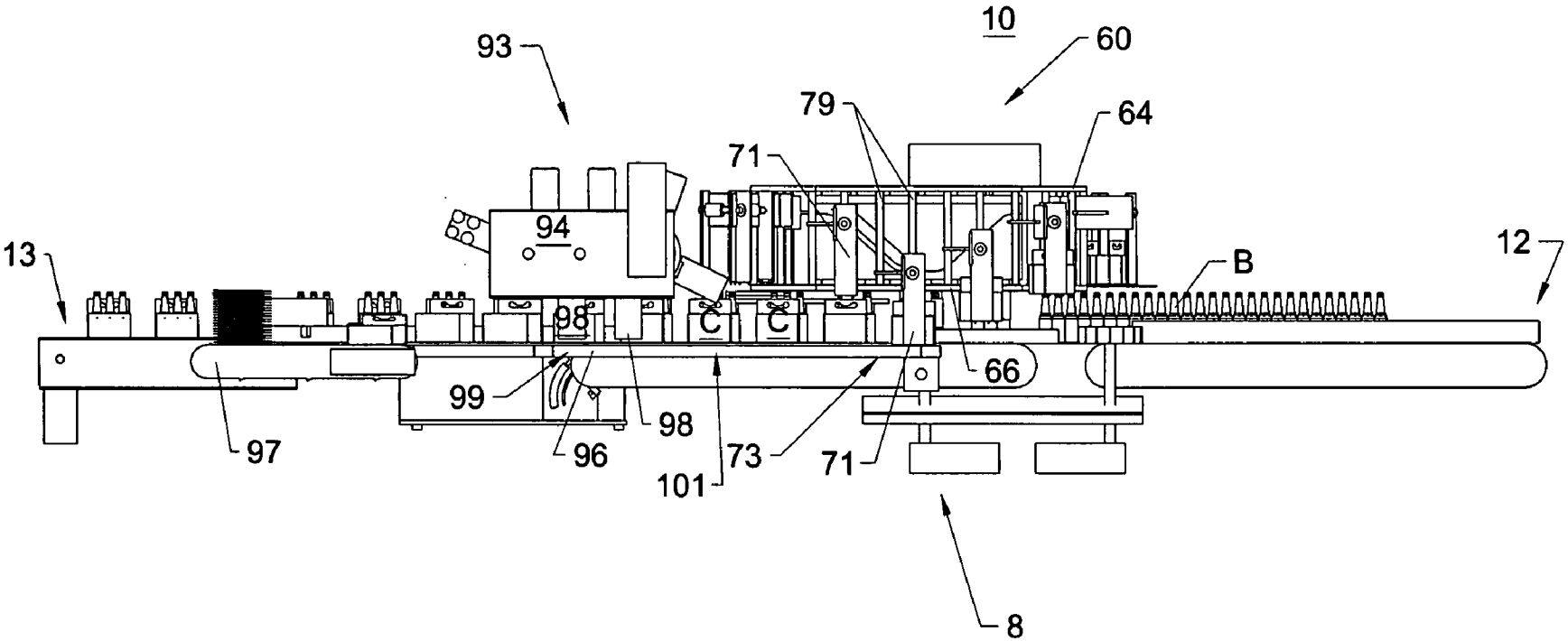
FIG. 6 is a side elevational partial schematic view of the packaging system.

Referring to FIGS. 5 and 6, the carton infeed system 90 and the opener 93 provide a supply of cartons to the loading carousel 60. Cartons C are initially fed into the packaging system 10 at the carton infeed system 90. The cartons C can be infed at a variety of points or locations, for example. The infeed system 90 can include, for example, a carton infeed conveyor 97 that provides an initial supply of cartons C, and a carton transport conveyor 96 that transports the cartons C through the opener 93 and along the first side 8 of the carousel 60. The carton infeed system 90 may be positioned slightly downstream from the loading carousel 60 and opposite to the closing mechanism 86, and provides a substantially continuous flow or line of opened cartons C to the loading carousel 60. The carton infeed system 90 may be positioned in a vertically raised arrangement above the outlet mechanism 110.

The opener 93 can include a carton opening apparatus or mechanism such as disclosed in U.S. Pat. No. 6,240,707, the entire disclosure of which is incorporated herein by reference. In general, the opener 93 can include a frame 94 having a guide slot or track. A series of carton opening assemblies 98 are transported about the frame 94, moving between a carton pickup or engaging position 99 and a discharge position 101, in which the opened cartons C are released and further conveyed along the carton transport conveyor 96. The opening assemblies 98 are conveyed about the opener 93 for picking up flat folded cartons C and opening the cartons to an opened position before release at the discharge position 101. The opener 93 also can include an adjustable internal opener cam that generally reduces the maximum height of the cartons C, which reduces the opener head mast/radius. Further, an adjustable internal opener cam can be provided for enabling opening of varying size cartons.

The loading carousel 60 loads the bottles B supplied by the selector station 30 into the opened cartons C provided by the opener 93. Two sides 8, 9 of the loading carousel 60 are utilized in the packaging system 10. The structure and operation of the loading carousel 60 are discussed in detail below.

Referring to FIGS. 3, 4A and 4B, the loading carousel 60 is mounted adjacent to and extends along the upstream or inlet end 49 of the packaging line 45. The loading carousel 60 includes upstream and downstream rotating supports 62 and 63, respectively, that are engaged with upper and lower chains or belts 64 and 66, respectively, that are moved about a substantially elliptical path by the rotation of the upstream and downstream supports 62 and 63. Rotation can be effected by motors or other drive mechanisms, for example. The rotating supports 62 and 63 may be sprockets having teeth that engage the chains 64, 66, respectively, for example. The rotating supports 62, 63 may alternatively be gear or belt-driven. The carton transport conveyor 96 on the first side 8 of the loading carousel 60 may be spaced from and extend parallel to the packaging line 45 on the second side 9 of the carousel 60. The second side 9 of the loading carousel 60 may extend from a point slightly upstream from the inlet end 49 of the packaging line 45 approximately to the discharge end 51 of the packaging line 45.

Figure 7:
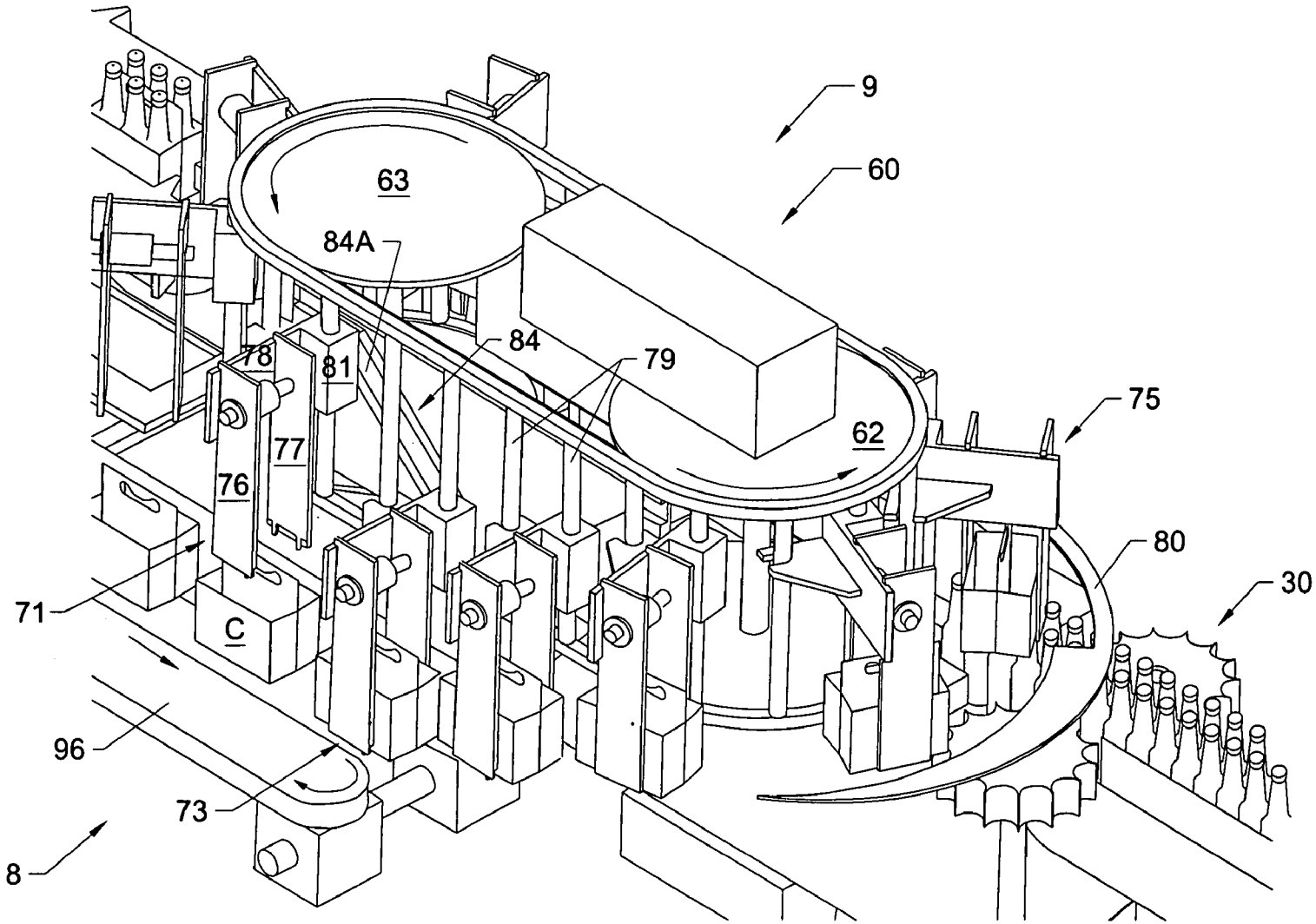
FIG. 7 is a partial perspective view showing the operation of the loading carousel.

FIGS. 6 and 7 illustrate the first side 8 of the loading carousel 60, where the carousel 60 receives and picks up the opened cartons C from the carton transport conveyor 96. The loading carousel 60 includes a series of carton carriers 71 that are carried along an elliptical path in the direction of arrows 72 (FIG. 3) by the rotation of the loading carousel 60. The rotation conveys the carriers 71 to first, lowered pickup position 73, where the carriers 71 pick up the cartons C. The carriers 71 subsequently transport the cartons C to a second, lowered loading or article receiving position 74 (FIG. 4B) along the second side 9 of the carousel 60, where the cartons C are placed about groups of bottles B. Each of the carriers 71 generally will include a spaced pair of arms 76 and 77 extending vertically downwardly from a laterally extending support plate 78. Each support plate 78 is attached to and is carried by a pair of vertically extending support rods 79 so as to transport the carriers 71 about the periphery of the loading carousel 60, while also allowing for vertical translation of the carriers 71. Each support plate 78 may be connected to a block 81, which may be connected to one of each pair of the support rods 79 by an angled plate 82. The carriers 71 also are typically operated without a back wall to allow better carton side guides at the pick up position 73, and can be adjusted by a screw, or otherwise, for example, to accommodate various container sizes.

A cam follower or guide 83 may be attached to each of the blocks 81 or to the support plates 78. Each cam follower 83 will generally engage and move along a cam track 84 in the loading carousel 60 as the carriers 71 are moved about the carousel 60. The cam track 84 generally has a first, pickup cam profile or side 84A. extending along the first side 8 of the carousel 60, and a second or loading side profile 84B extending along the second side 9 of the carousel 60. As a result, the carriers 71 are moved between the lowered and raised positions shown in FIGS. 4B and 7, respectively, during the transport of the cartons C from the pickup position 73 (FIG. 7) to the article loading or engaging position 74 (FIG. 4B). As the cartons C are moved along their path of travel from the pickup position 73 to the article loading position 74, the cartons C will be raised to an intermediate, raised position 75 (FIG. 4B).

Referring to FIG. 4A, the cartons C are then conveyed into alignment with the bottle groups being formed therebeneath along the packaging line 45, and then lowered in timed relation to the movement of the groups of bottles B along the packaging line 45 so that each carton C is matched with a group of bottles B and thereafter progressively lowered down over the bottles at the article loading position 74. The cartons C may have channels, cavities or other compartments in which the bottles B are received, as illustrated in FIG. 4B. A plow 80 may be included to manipulate base flaps of the cartons C, if present, and may function to hold the flaps outwardly so that the cartons C are more easily lowered over the bottles B. For the purposes of clarity of illustration, the opened bottom flaps of the bottles B are not shown in the Figures.

Referring to FIG. 4B, after the bottles B are received in the channels of the cartons C, the arms 76 and 77 of the carriers 71 can be raised out of engagement with the loaded cartons C as the cartons C are engaged by the closing mechanism 86 (FIG. 3). The closing mechanism 86 may be conventional in operation and can include a flap tucking mechanism that engages and tucks locking tabs or flaps along the bottom surfaces of the cartons into a locked arrangement. Alternatively, the closing mechanism 86 can include a folder/gluer mechanism that applies a bead of glue between the bottom flaps of the cartons and thereafter presses the bottom flaps into engagement with one another to seal them together. The finished, closed cartons C are then fed further downstream for transfer to the discharge or outlet mechanism 110.

As illustrated in FIG. 4A, the packaging line 45 extends in the direction of arrow 46, and may be spaced from and substantially parallel to the path of travel 17 of the flow of products on the infeed conveyor 16. The packaging line 45 may include, for example, a conveyor belt 47, although other, similar types of conveying mechanisms also can be used, for transport of the groups of bottles B. The conveyor belt 47 moves about a substantially elliptical path between the upstream end 49 and the downstream end 51, at which point the loaded packages P are delivered to the outlet mechanism 110.

The system 10 detailed herein can utilize a variety of drives, including servo-motors, stepper motors, AC or DC motors, pneumatic or hydraulic drives that operate, or are connected to, the following operative elements: the loading carousel, the opener, the closing mechanism, the starwheels, the selector station, the container infeed, etc. Other units can be mechanically or servo driven or can slave off of existing drives (e.g., carton feeding could drive off of the carousel drive).

The packaging system 10 described herein can utilize a standard two lane infeed conveyor arrangement as illustrated. The system 10 layout can also be widened with bottles B infeeding alongside the carton feed and around the outside of the carousel 60 head shaft. The starwheels 31 and selectors 33 may be of a design and construction as found in the Autoflex 1500 as manufactured by Graphic Packaging International, Inc.

Figure 8:
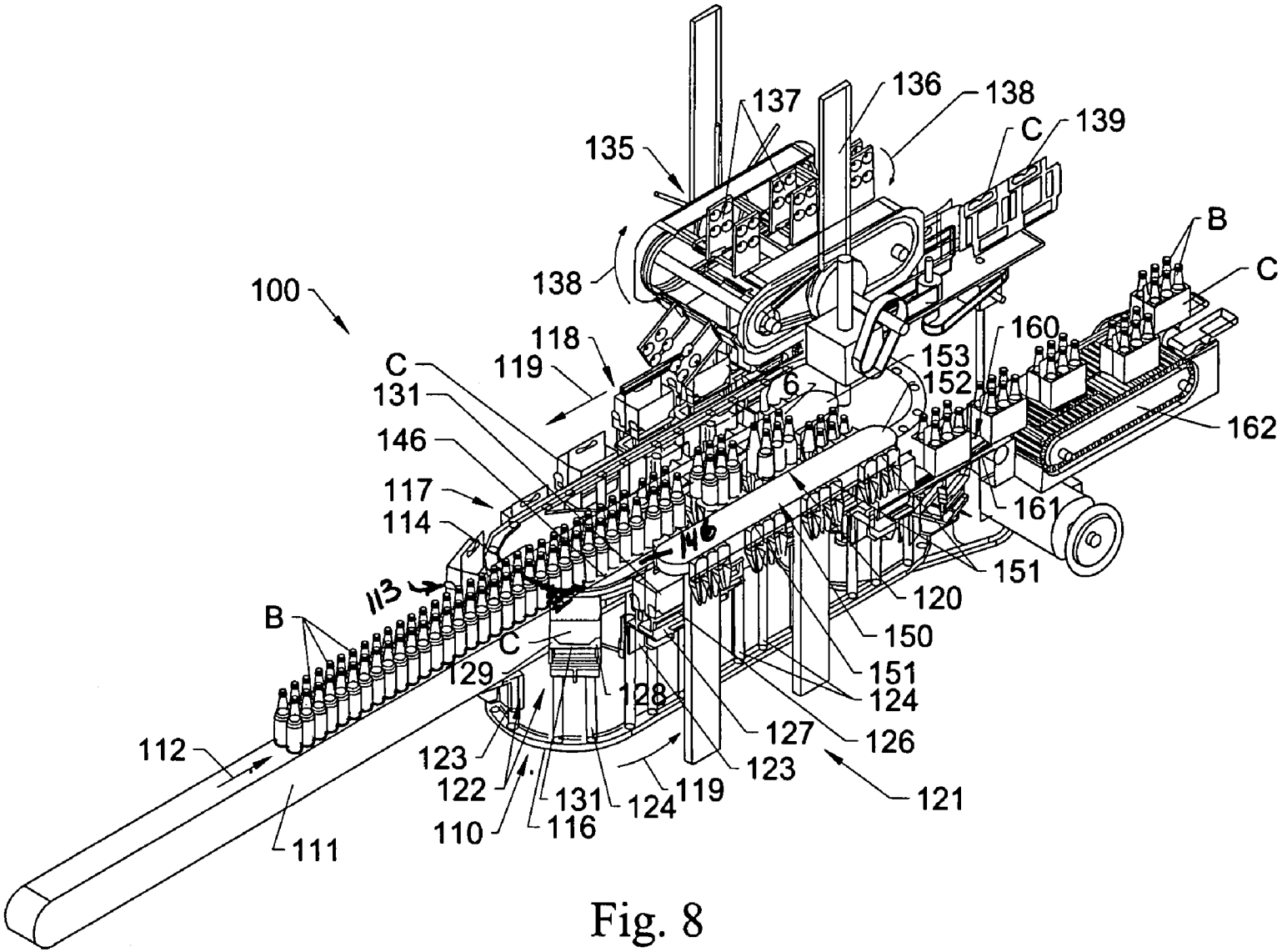
FIG. 8 is a perspective view of an additional embodiment of a packaging system according to the present invention.
Figure 9:
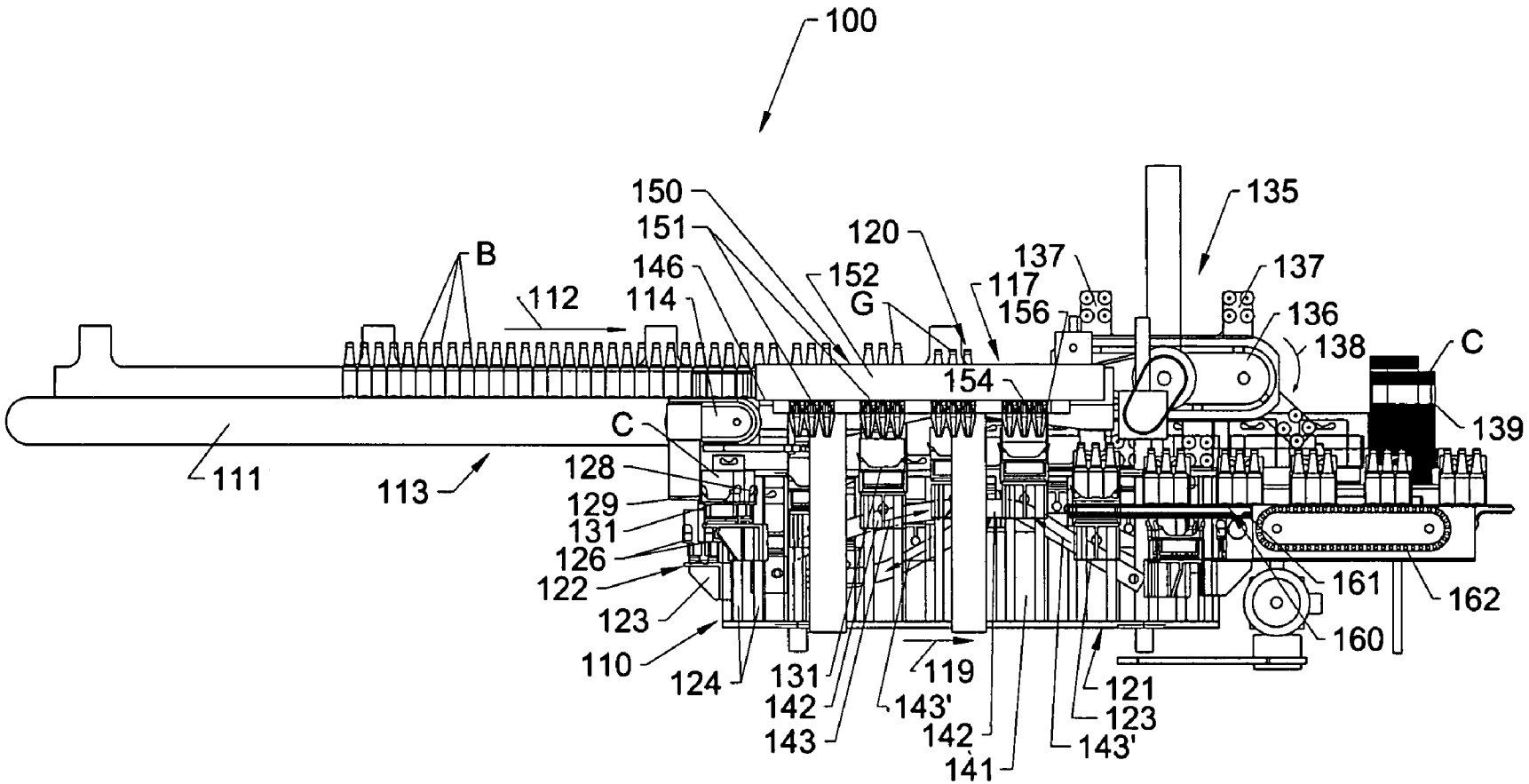
FIG. 9 is a side elevational view showing the loading of products into basket type packages according to the embodiment of FIG. 8.

FIGS. 8-11 illustrate a second embodiment of the packaging system 100 according to the principles of the present invention. As discussed above with respect to the embodiment of FIGS. 2-7, the packaging system 100 (FIGS. 8 and 11) of the present embodiment will include a loading carousel 110 for loading articles or products, such as bottles B or other similar products, into cartons C, here illustrated as basket-type cartons or containers, each having a series of compartments defined therein. As illustrated in FIGS. 8 and 9, the articles to be packaged, such as bottles B, are conveyed in one or more lanes or lines of articles along an article infeed path into the packaging system 100 along an article infeed conveyor 111 in the direction of arrow 112. In this embodiment, the article infeed conveyor 111 typically enters the packing system 100 at the upstream end 113 of the packaging system, generally at an elevated position with respect to the loading carousel 110 and terminating at a discharge point 114.

Figure 10:
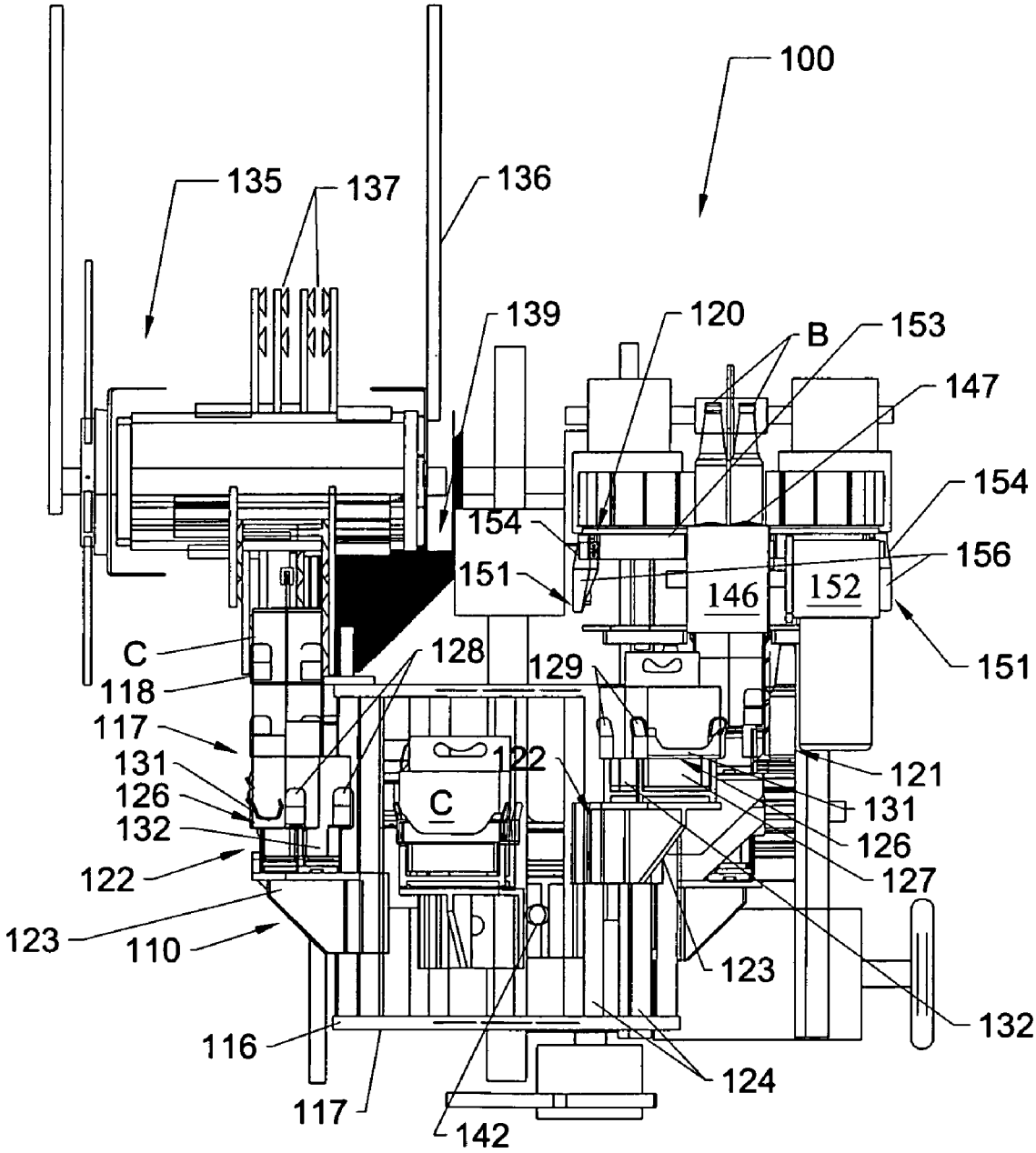
FIG. 10 is an end view of the upstream or inlet end of the packaging system of FIG. 8.

The loading carousel 110 includes a substantially elliptically shaped frame 116 having a first side 117 along which the open carton C are engaged and picked up at an initial or pickup point 118 (FIG. 8). The cartons thereafter are conveyed about the loading carousel along a loading path in the direction of arrow 119 under the article infeed conveyor 111, to a loading point 120 along a second side 121 of the loading carousel. The loading carousel 110 further includes a series of carriers 122 for conveying cartons about their loading path indicated by arrow 119. As illustrated in FIGS. 8-10, each of the carriers 122 generally includes a base 123 that is slideably mounted on a pair of vertically extending support rods 124 that are attached to the frame 116 of the loading carousel so as to be rotated therewith to move the carriers about the loading path 119.

Container or carton supports 126 (FIGS. 9-10) are mounted on the base of each carrier 122, and are typically vertically spaced from their base 123 by upstanding plates or brackets 127. Each of the container supports generally is a U- or C-shaped member having front and rear walls 128 and 129, respectively, with a longitudinally extending section or portion 131 therebetween. The container supports 126 further are spaced apart, as indicated in FIG. 10, so as to define a space or passage 132 therebetween. The cartons C are received from a carton opener 135 (FIGS. 8, 9) positioned along the first side 117 of the loading carousel, upstream from the carton pickup point 118, as the carriers are moved along an initial or upstream portion of the carton loading path 119. The carriers receive the opened cartons with the front and rear corners of the cartons engaging the corners between the front and rear walls and intermediate sections of each of the container supports, and with the outer side edges of the cartons being supported by the intermediate sections 131 (FIG. 9) of each of the container supports 126.

The carton opener 135 generally will have a substantially similar construction to the carton opener as described above with respect to the embodiment of FIGS. 2-7, generally including a frame 136 (FIG. 8), about which a series of carton opening assemblies 137 are conveyed in the direction of arrows 138. The carton opening assemblies 137 will engage and pick flat folded cartons C from a magazine 139, or similar supply of cartons, progressively opening the cartons before releasing the cartons C onto the container supports 126 of each of the carriers 122 at the pickup point 118 as indicated in FIGS. 8 and 10.

Figure 11:
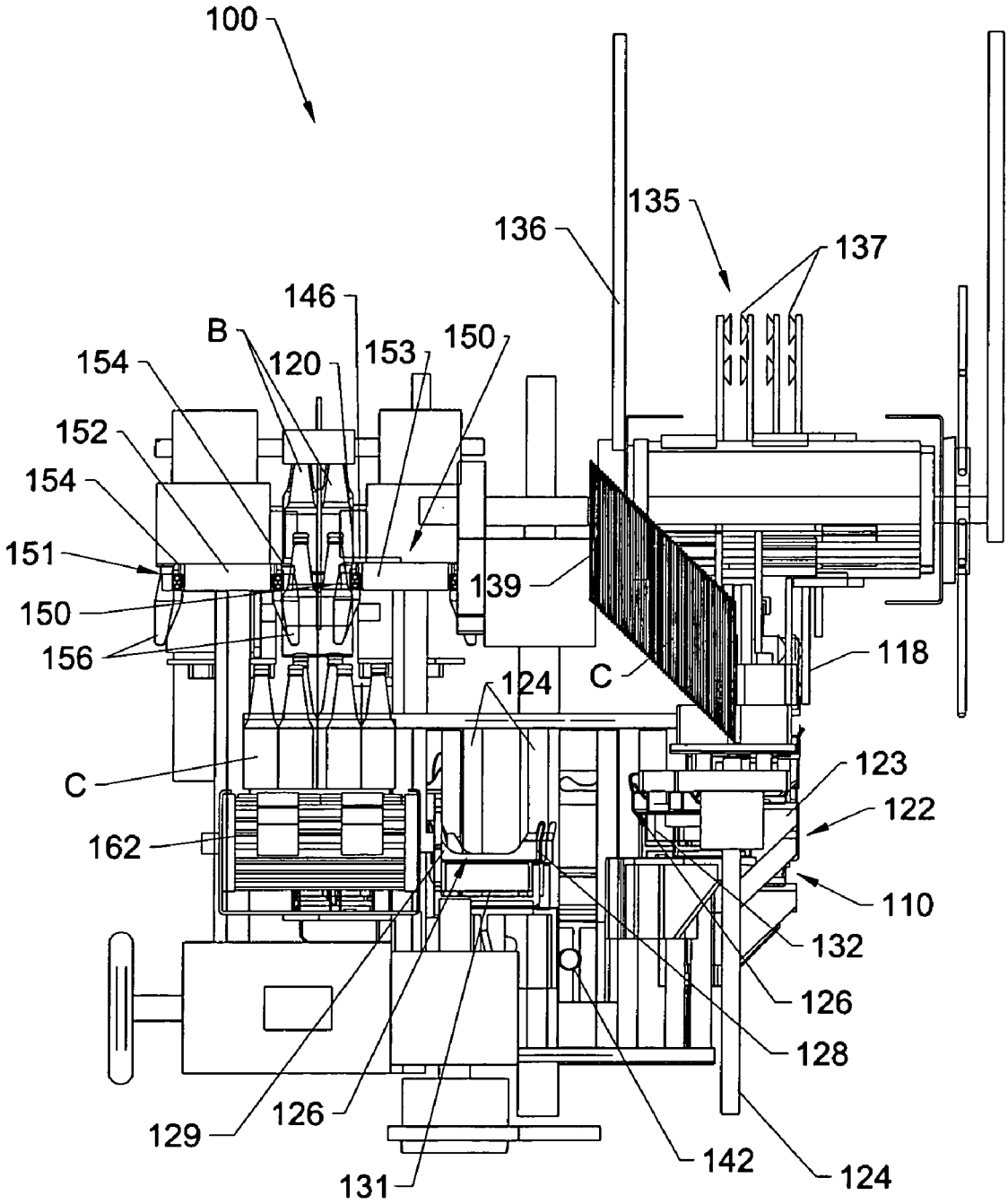
FIG. 11 is an end view of the downstream or outlet end of the packaging system of FIG. 8.

As generally illustrated in FIG. 9, a cam track 141 is mounted within the frame 116 of the loading carousel 110, extending along a substantially elliptical path within the confines of the loading carousel frame. A cam follower or roller 142 is attached to a rear side surface of the base 123 of each of the carriers 122 and engages and rolls along the cam track as the carriers are transported around the loading carousel 110 in the direction of arrows 119. As a result, as the cam followers roll along the cam track 141, the carriers are moved upwardly and downwardly in the direction of arrows 143 and 143' as indicated in FIG. 9. Such movement causes the carriers, and thus the cartons carried thereby, to be raised and lowered as the carriers are transported about the loading carousel 110 along the initial or upstream, intermediate, and downstream portions of the loading path 119 of the cartons. As indicated in FIG. 8, the carriers accordingly are transported from a raised configuration at the pickup point 118 wherein the opened cartons C are loaded into each of the carriers 122, and are lowered as the cartons are conveyed along the intermediate portion of the loading path 119, so as to pass beneath the article infeed conveyor 111. Thereafter, the cartons will be raised to an elevated position as they move along the downstream portion of their loading path, coming up from beneath the bottles B at the loading point 120 for loading the bottles into the cartons, as indicated in FIGS. 8 and 11.

As generally illustrated in FIGS. 9 and 10, a dead plate 146 can be mounted at the discharge end 114 of the article infeed conveyor 111, extending longitudinally therefrom between the discharge end of the article infeed conveyor 111 and the loading point 120 of the carriers 122. The dead plate typically will be a substantially flat, longitudinally extending plate having a smooth upper surface 147 along which the bottles are received and moved for loading into their respective cartons.

A selector station 150 (FIGS. 8 and 9) is mounted along the dead plate 146 for engaging and grouping the bottles into selected groups G, such as in six-pack configurations as illustrated in FIGS. 8 and 9, or in other configurations or arrangements as needed or desired. The selector station 150 can include a series of selectors such as selector wedges or blocks 151 arranged in groups or series, such as in groups of 1-3 selector wedges moving along both sides of the dead plate. The selector wedges 151 generally will be mounted on and conveyed into engagement with the bottles B by conveyors 152 and 153 extending on each side of the dead plate and article infeed path. Each of the selector wedges 151 (FIG. 11) typically can include a substantially arcuate-shaped upper portion or base 154, defining a recess in which one of the bottles will be received, and a downwardly extending guide or finger portion 156. The guides 156 are each adapted to engage and be received within a compartment of a carton C as the cartons are raised toward bottles at the loading point 144.

As indicated in FIGS. 8-10, the selector wedges generally will engage a series of products, i.e., 1-3 bottles, so as to create a product group G, such as a six-pack of bottles, that are separated and moved forwardly along the dead plate and away from the article infeed conveyor, toward the loading point 120. At the loading point, the bottles will be lowered or dropped into the compartments of their respective cartons C as the cartons are raised toward the bottles by the upward movement of the cam followers 142 of the carriers 122 along their cam track 141, as indicated in FIGS. 9 and 11. The fingers or guide portions 156 of each of the selector wedges 151 are received within the compartments of the cartons and tend to guide the bottles into their respective compartments of the cartons to control the feeding of the bottles therein to reduce or minimize mis-feeding and/or the shock or jarring forces translated to the carriers and support rods from the bottles dropping into the cartons.

As illustrated in FIG. 9, after the bottles have been received within the compartments of their associated cartons, the cartons thereafter are progressively lowered as the cam followers 142 of the carriers 122 continue along the cam track 141 in the direction of arrows 143. As the carriers are moved forwardly downwardly, the cartons are deposited onto a takeoff conveyor 160 (FIGS. 8 and 9). The takeoff conveyor generally comprises a narrow conveyor belt 161 of a size adapted to be received within the passage 132 defined between the container supports 126 of each of the carriers. As indicated in FIG. 9, the carriers deposit their cartons C onto the conveyor belt 161 of the takeoff conveyor 160, as the carriers are moved forwardly and are lowered by the continued downward movement of their cam followers 142 along the cam track 141. The carriers are lowered to an elevation below the elevation of the takeoff conveyor 160, so that the carriers can be turned and pass therebeneath without interference with the takeoff conveyor 160 or the cartons contained thereon.

Thereafter, as indicated in FIG. 8, the loaded cartons C are transferred to a discharge conveyor 162, with the loaded cartons typically being divided into two or more lines or paths. The discharge conveyor 162 will thereafter discharge the loaded cartons away from the packaging system 100 to a downstream station such as a case packer or other station for collecting and packaging the loaded packages or cartons for storage and/or transport.

The loading carousels illustrated in the Figures have a two-sided configuration generally utilizing two spaced, rotating supports. An alternative loading carousel can have, for example, three sides formed by three rotating supports. The functions of pickup and loading can be performed, for example, along two or more of the three sides of the carousel. Another alternative loading carousel could be rectangular in shape, with the functions of pickup and loading of the cartons performed along two or more of the four sides of the carousel. In addition, although two sides of the packaging system of the present invention could be tended by an operator, the packaging system can account for any missed cartons in the loading function on the first side of the loading carousel by a single operator positioned along the second side of the packaging system.

The present invention further is suitable for loading a variety of articles in a variety of containers. Suitable articles include, for example, bottles as shown in the drawings, cans or similar articles. Suitable containers can include, for example, paperboard cartons and basket type containers or carriers. The containers used with the packaging system can include, for example, a glued base, locking tabs, and/or other types of carton closures. The packaging system further can utilize existing style basket containers or can operate with alternative base hole patterns for engagement by a transport conveyor. The base crease hole pattern of the cartons C can be configured or created with an existing Graphic Packaging International, Inc. "A-B Ruff-Rider" die, or a similar die, with base crease holes added. Two pairs of base crease holes can be added, one for use by the container infeed and one for use by the carousel. The two pairs of base crease holes provide a larger transfer target and eliminate lug/finger interference, as well as allow the possibility of repitching the input or carton transport conveyor to between a 12.5" paper feed and a 10" pitch carousel for higher packaging per minute at lower linear speeds. The packaging system further generally can allow for a surge requirement of up to at least 250 packages formed per minute.

It will be understood by those skilled in the art that while the invention has been discussed above with reference to preferred embodiments, various changes, modifications and additions can be made thereto without departing from the spirit and scope of the invention as set forth in the following claims.

What is claimed is:

1. A packaging system for packaging articles into containers, comprising:

a loading carousel having a first side along which the containers are received and opened and a second side along which opened containers are conveyed for loading;

an article infeed system positioned to feed articles to the loading carousel along a path adjacent the second side of the loading carousel; and a discharge conveyor disposed along the second side of the loading carousel;

wherein the loading carousel transports the containers from a pickup on the first side of the loading carousel to a loading position along the second side of the loading carousel, with the containers being moved upwardly from below the articles for receiving the articles therein, after which loaded containers are received on and conveyed away from the loading carousel by the discharge conveyor, and wherein the loading carousel comprises a frame, a cam track extending about the frame, and a plurality of carriers moveable along the cam track and about the frame between a pickup position for receiving a container and a loading position at which the containers are loaded with articles.

2. The packaging system of claim 1 and wherein each of the carriers comprises a base mounted on a pair of support rods attached to a rotating frame of the carousel, a cam follower mounted to the base and adapted to engage and move along the cam track for causing the carriers to be raised and lowered, and a pair of spaced container supports adapted to engage and support the containers along side edges and corners thereof.

3. A packaging system for loading a series of articles into containers, comprising:

a container infeed system:

a loading carousel including a frame having a first side, a second side, and a plurality of carriers moveable about the carousel frame, wherein the container infeed system provides containers to the first side of the loading carousel for pickup by the carriers for transport to a loading portion along the second side of the loading carousel;

an article infeed system extending adjacent the loading carousel and feeding articles to the loading carousel; and a selector station positioned along the second side of the loading carousel upstream from the loading position for arranging the articles from the article infeed system into article groups and forwarding the article groups to the loading position;

wherein the carriers are raised to an elevated position as they are moved about the frame of the loading carousel and approach the loading position, so as to move the containers into a position for receiving the articles therein as the article groups are moved to their loading position along the second side of the loading carousel, and wherein the loading carousel further comprises a cam track along which the carriers are conveyed as they move about the loading carousel, the cam track having a lowered portion and a raised portion for moving the carriers between elevated and lowered positions.

4. The packaging system of claim 3, wherein the container infeed system comprises a container conveyor and a container opener.

5. The packaging system of claim 3, and wherein each of the carriers comprises a base slideably mounted on a pair of support rods attached to the frame of the carousel, a cam follower mounted to the base and adapted to engage and move along the cam track for causing the carriers to be raised and lowered, and a pair of spaced container supports adapted to engage and support the containers along side edges and corners thereof.

6. The packaging system of claim 3 and further comprising a series of product guides each adapted to be received within one of a plurality of compartments of the cartons for guiding articles into the compartments of each of the cartons.

* * * * *